US012698947B2

(12) United States Patent
Fountain et al.

(10) Patent No.: US 12,698,947 B2
(45) Date of Patent: Aug. 4, 2026

(54) APPARATUS FOR PROVIDING AN INTERFACE BETWEEN A MISSILE AND A LAUNCH PLATFORM

(71) Applicant: MBDA UK LIMITED, Stevenage (GB)

(72) Inventors: Dominic Philip Frederick Fountain, Stevenage (GB); Andrew James Charlton, Stevenage (GB)

(73) Assignee: MBDA UK LIMITED, Stevenage (GB)

( * ) Notice: Subject to any disclaimer, the term of this patent is extended or adjusted under 35 U.S.C. 154(b) by 43 days.

(21) Appl. No.: 18/837,341

(22) PCT Filed: Feb. 8, 2023

(86) PCT No.: PCT/GB2023/050279

§ 371 (c)(1),
(2) Date: Aug. 9, 2024

(87) PCT Pub. No.: WO2023/152484

PCT Pub. Date: Aug. 17, 2023

(65) Prior Publication Data

US 2025/0164211 A1 May 22, 2025

(30) Foreign Application Priority Data

Feb. 10, 2022 (EP) ..... 22156187
Feb. 10, 2022 (GB) ..... 2201731

(51) Int. Cl.
*F41F 3/06* (2006.01)

(52) U.S. Cl.
CPC ..... *F41F 3/06* (2013.01)

(58) Field of Classification Search
CPC ..... F41F 3/06; F41F 7/00; F41F 3/042; F41F 3/0406; B64D 1/06; B64D 1/02; B64D 1/04; B64D 3/00; B64D 5/00; F42B 15/36
See application file for complete search history.

(56) References Cited

U.S. PATENT DOCUMENTS 2,780,422 A * 2/1957 Maglio, Jr. ..... B64D 5/00 244/135 A
2,843,337 A * 7/1958 Bennett ..... F16C 11/069 244/2

(Continued)

FOREIGN PATENT DOCUMENTS

EP 0227211 A1 7/1987
JP 09138098 A * 5/1997

(Continued)

OTHER PUBLICATIONS

International Search Report dated Apr. 19, 2023 issued in PCT/GB2023/050279.

(Continued)

*Primary Examiner* — Joshua E Freeman
(74) *Attorney, Agent, or Firm* — Scully, Scott, Murphy & Presser, P.C.

(57) ABSTRACT

There is disclosed apparatus for providing an interface between a missile and a launch platform. The apparatus comprises one or more rocket motors, and a jettison device operable to jettison the apparatus from the missile. The apparatus is configured to launch from the launch platform with the missile and to jettison from the missile after operation of the rocket motors. A missile adapted to be launched with the apparatus is also disclosed.

18 Claims, 3 Drawing Sheets

(56) References Cited

U.S. PATENT DOCUMENTS

| | | | | |
|---|---|---|---|---|
| 3,727,569 | A | 4/1973 | Johnson et al. | |
| 4,453,426 | A * | 6/1984 | Groutage | B64U 30/12 244/49 |
| 4,842,218 | A * | 6/1989 | Groutage | F41F 3/06 244/3.28 |
| 5,141,175 | A * | 8/1992 | Harris | F42B 15/36 244/3.28 |
| 5,295,642 | A * | 3/1994 | Palmer | B64G 1/14 244/171.4 |
| 6,068,211 | A * | 5/2000 | Toliver | B64G 1/14 244/171.4 |
| 6,082,675 | A * | 7/2000 | Woodall, Jr. | F42B 12/365 244/49 |
| 6,293,202 | B1 * | 9/2001 | Woodall | F42B 19/10 102/386 |
| 7,997,180 | B2 * | 8/2011 | Soderberg | B64D 7/08 89/1.819 |
| 8,727,264 | B1 * | 5/2014 | Rutan | B64D 1/12 244/171.1 |
| 8,740,134 | B2 * | 6/2014 | Suzuki | G05D 1/104 244/75.1 |
| 10,179,648 | B2 * | 1/2019 | Chin | B64D 5/00 |
| 10,684,095 | B1 * | 6/2020 | Brindle | F41F 3/065 |
| 10,913,534 | B1 * | 2/2021 | Brum | B64U 30/12 |
| 2004/0211862 | A1 * | 10/2004 | Elam | B64U 20/83 244/58 |
| 2005/0082424 | A1 * | 4/2005 | Yamamoto | B64G 1/002 244/63 |
| 2005/0116110 | A1 | 6/2005 | Mitzmacher | |
| 2005/0134496 | A1 * | 6/2005 | Trainor | B64D 5/00 342/13 |
| 2005/0204910 | A1 * | 9/2005 | Padan | B64D 1/04 89/1.813 |
| 2011/0024548 | A1 * | 2/2011 | Kuroda | B64D 3/00 244/3 |
| 2011/0198434 | A1 * | 8/2011 | Ustinov | B64D 5/00 244/2 |
| 2014/0339371 | A1 * | 11/2014 | Yates | B64D 5/00 244/53 R |
| 2015/0021428 | A1 * | 1/2015 | Rutan | B64D 1/12 244/3 |
| 2015/0159587 | A1 | 6/2015 | Facciano et al. | |
| 2018/0265211 | A1 * | 9/2018 | Burgener | B64D 3/00 |
| 2019/0168887 | A1 * | 6/2019 | Burgener | B64D 3/00 |
| 2019/0315462 | A1 * | 10/2019 | Skladman | B64D 45/00 |
| 2020/0047885 | A1 * | 2/2020 | Gallo | B64D 1/12 |
| 2020/0064112 | A1 * | 2/2020 | Rami | F41G 3/04 |
| 2022/0009633 | A1 * | 1/2022 | Budd | B64D 5/00 |
| 2023/0034258 | A1 * | 2/2023 | Gallo | B64G 1/648 |

FOREIGN PATENT DOCUMENTS

| | | | |
|---|---|---|---|
| WO | 1989008582 | A1 | 9/1989 |
| WO | 1993009030 | A1 | 5/1993 |

OTHER PUBLICATIONS

GB Search Report dated Jul. 26, 2022 issued in GB2201731.3.
Extended European Search Report dated Jul. 15, 2022 issued in EP 22156187.1.

* cited by examiner

APPARATUS FOR PROVIDING AN INTERFACE BETWEEN A MISSILE AND A LAUNCH PLATFORM

FIELD

The present invention relates to apparatus for providing an interface between a missile and a launch platform.

BACKGROUND

Missiles can be launched from a launch platform using a variety of methods. For example, it is known to use launch rails, which may be suspended from an aircraft, to carry a missile and to constrain its motion on and immediately after launch. Generally rail launchers can be used on a number of platforms, including land vehicles and static ground-based platforms. Launch rails are used with missiles having their own propulsion systems, and these propulsion systems provide the thrust necessary to separate the missile from the launcher. By way of further example, launch can also be achieved using ejection release systems, which operate to propel the missile away from the launch platform, such that it is at a safe distance from the launch platform before its propulsion system is initiated. As will be understood, specific mechanical interface features must be provided on both missile and launch platform for any one launch system to operate.

SUMMARY

According to an aspect of the present invention, there is provided apparatus for providing an interface between a missile and a launch platform, the apparatus comprising one or more rocket motors, and a jettison device operable to jettison the apparatus from the missile; the apparatus being configured to launch from the launch platform with the missile and to jettison from the missile after operation of the rocket motors.

Herein, the term missile is used to refer to any munition that is capable of flight and equipped so as to be able to be guided during flight towards a target. The term is used to include both munitions that are equipped with some means of propulsion, such as a turbojet or rocket motor, and munitions that lack any means of propulsion themselves, but are capable of sustained glide through the provision of aerodynamic control surfaces.

In use, the apparatus provides an interface between the launch platform and the missile, until launch from the launch platform with the missile. The missile may not directly mechanically attach to the launch platform. The only mechanical attachment of the missile to the launch platform can be via the apparatus.

The launch platform may be an aircraft. In some embodiments, the launch platform may be a helicopter.

Use of the apparatus provides platforms with access to a wider variety of missiles. By way of example, certain missiles are designed for drop launch from fast jet aircraft. However, smaller, lighter platforms such as helicopters often do not have access to such missiles, using instead effectors such as laser guided rockets which may have a range, in rough terms, of up to 10 km, if launched from a relatively high altitude. Use of the apparatus enables the helicopter to carry missiles designed for fast jet aircraft with minimal adaptation to the missile itself. The rocket motors provide an initial boost to the missile, after which it can operate as normal. The helicopter benefits from a longer range effector (a fast jet drop-launched cruise missile, for example, could have a range greater than 100 km, and even in the less optimal low altitude helicopter launch conditions will achieve a range several orders of magnitude greater than current helicopter weapons), with a corresponding greater stand-off distance from any potential target, and also from the ability to launch at a relatively low altitude, the missile being able to climb during the initial boost phase of its trajectory. Thus the helicopter benefits from increased survivability.

The apparatus may further comprise one or more sensors, said one or more sensors including one or more of: an altimeter, an inertial measurement unit, a satellite navigation system, a timer, and a tilt sensor.

The apparatus may further comprise a processor operable to initiate jettison of the apparatus from the missile; the apparatus being arranged such that, when the apparatus is mounted to the missile, wherein the processor is in operative communication with the sensors so as to determine when to jettison the apparatus from the missile. Said determination may be made in dependence on one or more predetermined conditions, said one or more predetermined conditions including one or more of: the missile speed; the missile altitude; time elapsed since launch from the launch platform; and position of the missile. The apparatus can therefore be jettisoned in dependence the missile reaching an appropriate point in its trajectory. For example, the apparatus may be jettisoned at an appropriate position so as to avoid damage when it falls to the ground. Alternatively it can be jettisoned after a particular location has been passed and once a particular speed has been attained; or after a certain amount of time has elapsed since launch from the launch platform, or since initiation of the rocket motors.

The jettison device may comprise an explosive bolt charge. The jettison device may comprise a squib charge.

The apparatus may further comprise: a first mechanical interface attachable to the launch platform; a second mechanical interface attachable to the missile; and an electronic interface arranged to provide electrical communication between the missile and the launch platform.

The launch platform may comprise a rail launcher, and the first mechanical interface may be configured to be attachable to the rail launcher. The missile may comprise lug mounts adapted for a drop launch, and the second mechanical interface may be configured to be attachable to the lug mounts. The apparatus thus enables a missile configured to be drop launched to be launched from a launch platform equipped with launch rails. In some cases, such as where the launch platform is a ground platform or naval vessel, drop launch is not possible, and so the apparatus enables a particular missile to be launched from a wider variety of platforms. The use of common munition stockpiles has considerable benefit in terms of reduced development costs, and reduced through life costs.

According to a second aspect of the present invention, there is provided a weapon system comprising a launch platform, a missile, and an apparatus for providing an interface between the launch platform and the missile, the apparatus comprising: a first mechanical interface attachable to the launch platform; a second mechanical interface attachable to the missile; an electronic interface arranged to provide electrical communication between the missile and the launch platform; one or more rocket motors; and a jettison device operable to jettison the apparatus from the missile; wherein the apparatus is configured to launch from the launch platform with the missile, and to jettison from the missile after operation of the rocket motors.

The launch platform may be an aircraft. In some embodiments the launch platform is a helicopter.

The launch platform may comprise a rail launcher, and the first mechanical interface may be configured to be attachable to the rail launcher. The missile may comprise lug mounts adapted for a drop launch, and the second mechanical interface may be configured to be attachable to the lug mounts.

According to a third aspect of the present invention, there is provided a method of adapting a drop-launch missile such that the drop launch missile can be launched in combination with the apparatus described above, the method comprising the steps of:

i. identifying external components on the missile that are incompatible with the apparatus; and ii. moving said external components to a location that is compatible with the apparatus, or removing said external components.

Such modifications enable the missile to be used in conjunction with the apparatus.

The method may further comprise the step of adapting the missile control surfaces such that they are suitable for controlling the missile during and immediately after operation of the rocket motors. Some aerodynamic stability surfaces may for example need to be removed to enable the missile to be launched from a different launcher from that for which it is designed.

BRIEF DESCRIPTION OF THE FIGURES

Embodiments of the invention will now be described by way of example only with reference to the figures, in which.

DETAILED DESCRIPTION

Some embodiments described herein relate to apparatus to provide an interface between a missile and a launch platform, enabling the missile to be launched from a wider variety of launch platforms without significant adaptations being necessary to the missile itself, and also providing additional thrust to the missile, for use in an initial boost phase of its flight. After the initial, boosted phase, the apparatus can be jettisoned so as to enable the missile to continue its trajectory operating in its normal flight mode. Also described are embodiments relating to a weapon system comprising the missile, the launch platform and the apparatus.

Figure 1A:
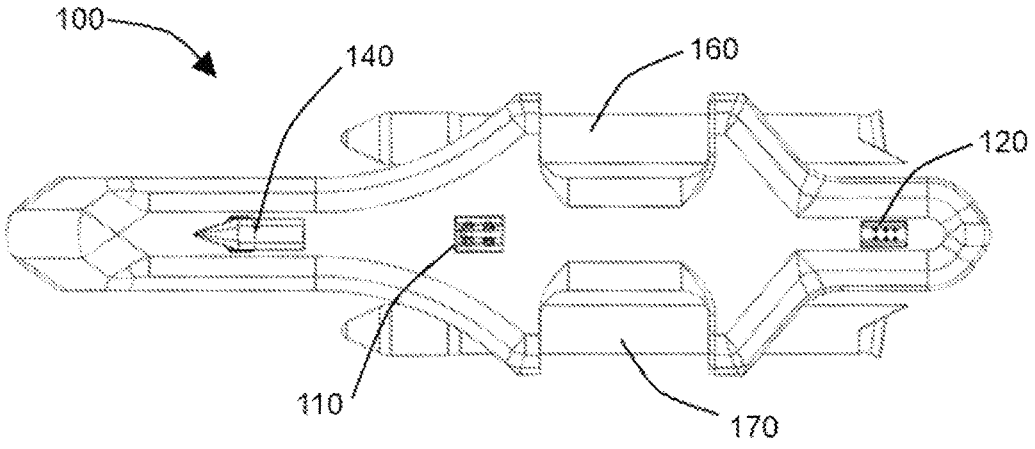
FIGS. 1*a* to 1*c* are schematic illustrations of apparatus in accordance with a first embodiment of the invention, each from a different perspective.
Figure 1B:
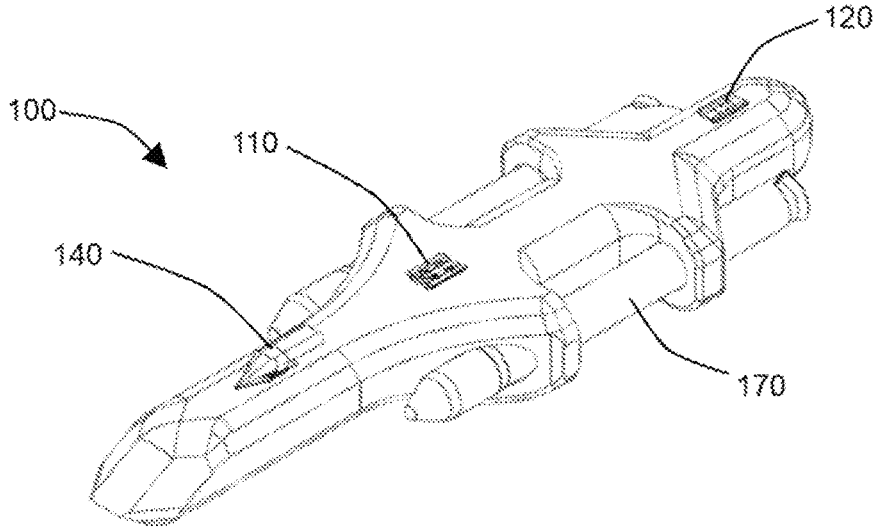
Figure 1C:
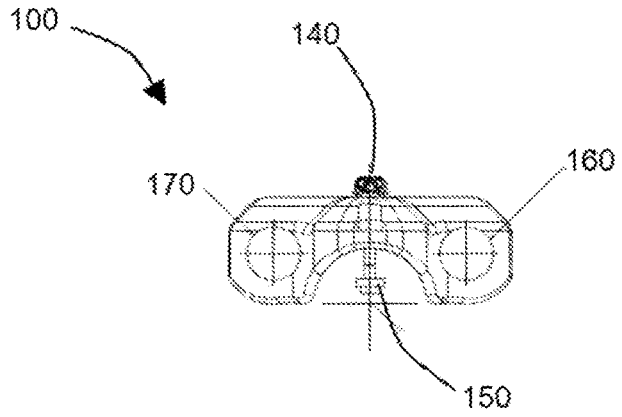
Figure 2:
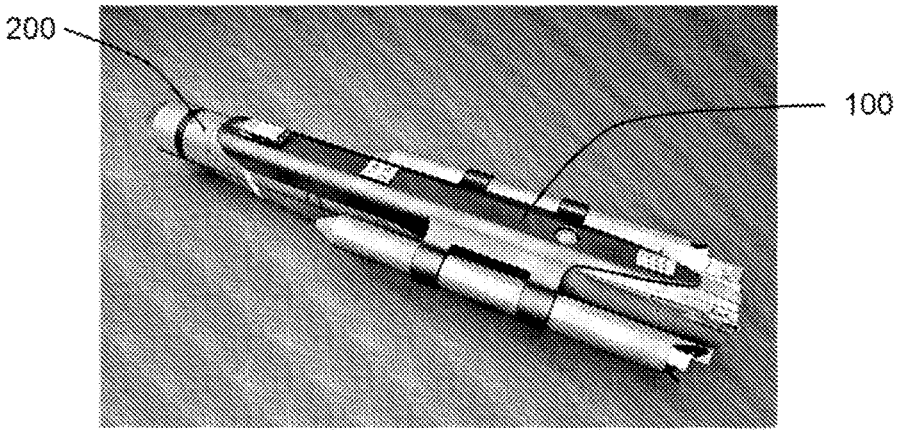
FIG. 2 is a schematic illustration of the apparatus mounted to a missile.

FIGS. 1*a*, 1*b*, and 1*c* are schematic illustrations of apparatus 100 intended to provide an interface between a missile and a launch platform. FIG. 2 is an illustration of a missile 200 attached to the apparatus 100. Apparatus 100 is configured to mechanically connect to a rail launcher attached to an aircraft. A forward hanger 110 and a rear hanger 120 are provided to slidably engage with a launch rail. An end stop is provided to hold the apparatus in place during air carriage. A shotgun connector 140 is provided to electronically connect the apparatus to the launch platform. The shotgun connector may connect the apparatus both to a power supply from the launch platform, and to a launch platform databus so that the apparatus can both communicate with the launch platform and enable communication between the launch platform and the missile. The hangers 110, 120, end stop and shotgun connector 140 are provided on a first, typically upper as shown in FIG. 1, portion of the apparatus 100.

Lug mounts 150 for interfacing with a missile are provided on a second portion of the apparatus opposing the hangers. Typically the lug mounts are provided on a lower portion of the apparatus 100, as shown in FIG. 1*c*. The lug mounts are configured to mechanically interface with the missile. The apparatus 100 is provided with a release mechanism so that, as described in further detail below, the apparatus can be jettisoned from the missile at an appropriate time. The release mechanism, and mechanical connection between the apparatus and the missile, will be configured as appropriate for the missile with which the apparatus is intended to operate. Appropriate release mechanisms are well-known in the field. A further connector is provided to enable the apparatus to electronically connect to the missile. The electrical connector is of the tear-off type. Such connectors are configured to disconnect on launch of the missile, or, in the case of the present apparatus, on jettison of the apparatus from the missile.

The apparatus 100 additionally comprises a processor to enable communication between the missile and the launch platform, via apparatus 100, and to enable the apparatus 100 to communicate with the launch platform and the missile. The apparatus 100 may be used to interface between a missile and a launch platform other than that for which the missile is designed. As a result it is possible that the databus standard used by the missile may be different to the databus standard used by the launch platform. Conversion between the launch platform and missile databus standards can be performed by appropriate software included in the processor. It is also possible that the power supply from the launch platform may not be compatible with the power supply required by the missile. In some embodiments, therefore, a power supply conversion adapter and power conditioning systems are also included within the apparatus 100. Those skilled in the art will appreciate that such conversions, as well as other adaptations necessary to enable the launch platform stores management system or launcher management system to communicate with the apparatus and, via the apparatus, the missile, can be achieved through standard platform integration work.

Rocket motors 160, 170 are mounted onto the apparatus. As is explained in further detail below, on launch from the launch platform, the apparatus and missile are launched in combination, with the apparatus attached to the missile by lug mounts. Rocket motors 160, 170 provide a thrust boost to the missile and apparatus combination on launch from the launch platform. The rocket motors operate until their fuel is burnt. The rate at which fuel is burnt during operation of the rocket motor may vary, and a particular burn profile can be determined on construction of the rocket motor. The rocket motors are selected to be appropriate for operational use of the apparatus and missile in dependence on the launch platform. For example, if there is a constraint on the overall weight that the launch platform is able to carry, smaller rocket motors having a shorter burn time may be appropriate, so as to reduce the overall weight of the apparatus and missile. Rocket motor design trade-offs can identify a compromise between the missile performance desired and the weight constraints of the launcher.

The apparatus further comprises a jettison device. Suitable devices are well known in the art and include squib charges, and explosive bolt charges. There is a risk that jettison of the apparatus may result in damage to the missile if the apparatus collides with any part of the missile, such as fins at the rear of the missile, immediately after jettison. This risk is mitigated by design of the apparatus, providing an offset between the rear end of the apparatus and any fins. In addition the operation of the jettison device can be modelled to ensure that the apparatus is ejected with a force sufficient to ensure its subsequent trajectory does not collide with the missile. The ejection force can be increased for example by increasing the size of the squib charge. Subsequent to the jettison, the missile continues its flight under the control of its standard guidance and flight control mechanisms.

Figure 3:
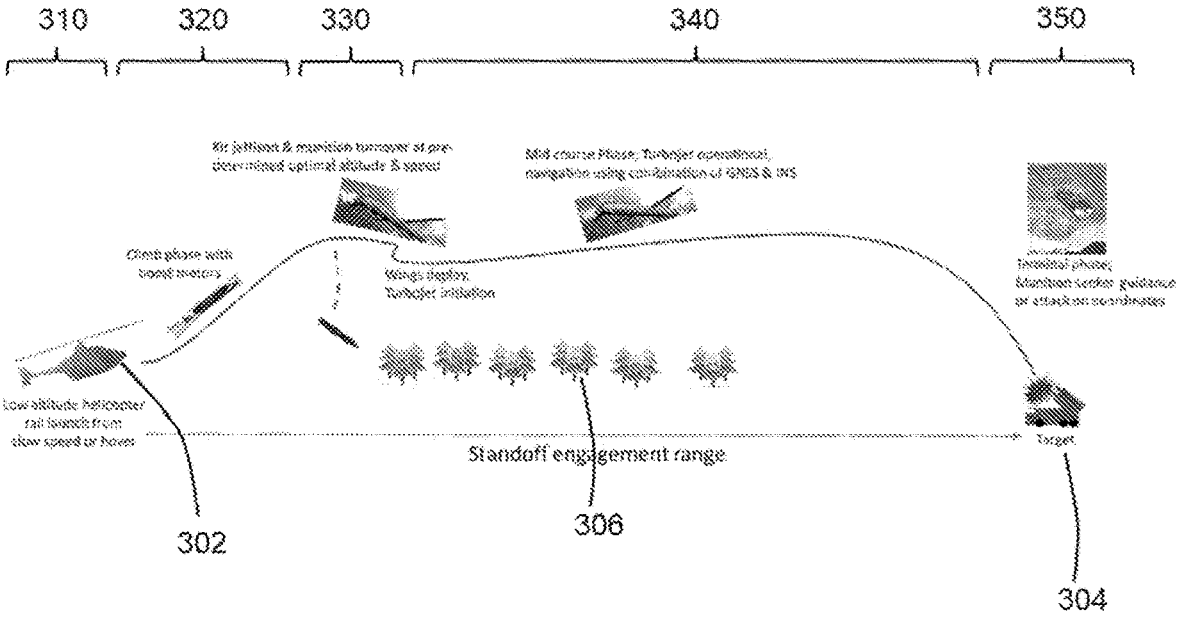
FIG. 3 is a schematic illustration of an exemplary flight profile for a missile launched in combination with the apparatus.

Operation of the rocket motors and jettison device is controlled by the processor 150. The processor includes a timer. The apparatus further comprises an inertial measurement unit, altimeter and tilt sensor. Operation of these components will now described in further detail with reference to FIG. 3, which schematically illustrates an exemplary engagement for a weapon system used in conjunction with the apparatus 100. The weapon system comprises a launch platform, which in the present example is a helicopter 302 equipped with a rail launcher, apparatus 100, and a missile designed to be drop-launched from a fast jet aircraft. Thus, in the exemplary engagement illustrated, the apparatus enables a missile designed to be drop-launched from a fast jet aircraft to be launched instead from a helicopter 302 equipped with a rail launcher. In addition the use of the apparatus enables the missile to be launched from a lower altitude than would normally be the case. Use of the apparatus also enables a larger stand-off distance between the launch point and a target 304. The lower altitude, and greater stand-off distance lower the risk to the helicopter platform. For example, the helicopter may stay at a low altitude such that obstacles 306 obscure the helicopter from the target 304.

At a first stage, 310, the apparatus and missile are launched from the helicopter. A signal is communicated to the apparatus from the helicopter to initiate launch and provide targeting details to the apparatus. The processor communicates necessary information to the missile processor and initiates the rocket motors 160, 170. Operation of the rocket motors provides generates thrust to propel the apparatus and missile along the launch rail away from the helicopter. The attitude of the helicopter can be controlled at launch such that the launch rail, and therefore the direction of the thrust generated by the rocket motors, is in an appropriate direction.

At a second stage 320, the rocket motors continue to propel the apparatus and missile until the rocket motors burn out. The apparatus and missile continue in combination until one or more predetermined conditions are met. These conditions can be determined by an operator prior to the launch. The predetermined conditions may include one or more of: the time elapsed since launch; the speed attained; the altitude attained; and the position reached. The predetermined condition may include a condition that the apparatus is not jettisoned in certain areas so as to avoid any potential damage being caused by the apparatus falling to the ground. The processor can determine time elapsed since launch; and communicates with the inertial measurement unit and altimeter provided in the apparatus to determine speed, altitude, and position.

Once the predetermined condition is met, at a third stage 330, the apparatus is jettisoned from the missile. This can be initiated by the processor. In an initial stage of the jettison process, the missile and apparatus turn over so that the apparatus is facing towards the ground. The tilt sensor is used to confirm that the apparatus is facing downwards prior to jettison. The apparatus 100 is then jettisoned by operation of the jettison device. The apparatus 100 then falls away. In the present example, the missile is equipped with a turbojet engine and has fold-out wings. After jettison, the missile operates in its normal manner. The wings fold out, and the missile is propelled along its trajectory by its turbojet engine. The turbojet engine can be initiated at an appropriate time to enable the missile to follow its intended trajectory. It may for example be spinning up prior to jettison of the apparatus so that it is able to propel the missile at cruise speed when the apparatus is jettisoned, or when the rocket motors burn out.

At a fourth stage 340, the missile continues its flight under its standard controls. Flight can be controlled using on-board navigation systems such as satellite navigation systems, or inertial navigation systems. At a fifth stage 350, the missile seeker systems are used for terminal navigation to guide the missile towards its target 304. Alternatively it can be used in an 'attack on coordinates' mode using navigation systems.

A number of modifications may be required in order to adapt a missile to be suitable for use in combination with the apparatus 100 as described above. The modifications will depend on the type of missile used. Typically a missile body will have a number of protrusions that could interfere with operation of the apparatus. These protrusions may interfere with rail launch, or may interfere with operation of the rocket motors or other parts of the apparatus. Antennae necessary for the operation of the missile, such as GNSS or datalink antennae, can be moved to a different location on the missile body at which no interference with operation of the apparatus is caused.

Certain aerodynamic stability surfaces that are necessary for drop launch missiles are not necessary for rail-launched missiles. Drop launch missiles can be provided with a stabilisation fin protruding vertically upwardly (i.e. in the direction of the launcher) during the drop phase which contribute to improving flight stability when the missile is dropped from a high altitude aircraft platform. The stabilisation fin would prevent rail launch, because it would collide with the launch rail during launch of the missile. However, the flight stabilisation provided by such a fin is not necessary in a propelled application from a launcher rail, and so it can be removed to enable the missile to be launched using apparatus 100.

Missile control surfaces may need to be deployed during the boost phase in order to provide control for the initial phase of the trajectory. Such deployment may require some modification of the missile since during this part of the trajectory the missile will remain attached to the apparatus. Control surfaces such as fins can be provided with fin lock mechanisms which operate to lock the fins before and immediately after launch, for safety reasons. These lock mechanisms can be overridden or modified to enable the missile control surfaces to deploy and control or correct the boost phase of the trajectory. As will be understood, missile control surfaces designed for a drop launch missile are not optimised for the high speed attained during the boost phase of the trajectory followed when launched in combination with the apparatus. As a result it is expected that the launch platform itself alter its orientation to ensure that the launch rail is pointing in approximately the right direction for the missiles initial flight path. In this way the missile control surfaces need only apply relatively small corrections, rather than needing to effect a change from missile level flight to a large missile climb angle.

The missile is also be provided with a mechanical switch to enable it to determine when the apparatus has been jettisoned. The switch is positioned such that it is depressed by the apparatus when the apparatus is attached to the missile, and released on jettison of the apparatus. The apparatus will affect the flight characteristics and performance of the missile. If jettison is not successfully accomplished for any reason, the missile will be able to take alternative action when jettison is not confirmed.

Certain software updates can also be performed. The missile guidance and control software can be updated to enable control of the boost phase of the missile trajectory. For example of the dropped missile, an update is provided to the guidance and control software to enable control of the boost phase of the missile trajectory. A further software update can be performed to enable communications interfacing to the platform stores or launcher management system. Alternatively or additionally, the apparatus processor may perform this interface function, avoiding the need for this software update.

Whilst a number of specific embodiments of the invention have been described in the above, those skilled in the art will appreciate that a number of variations and modifications to the above-described embodiments will be possible without departing from the scope of the invention which is defined in the accompanying claims. For example, whilst it has been described to use the apparatus in combination with an air platform, it will be appreciated that the apparatus can be used to enable a missile configured for drop-launch to be rail launched from a ground-based vehicle or static platform, or from a naval vessel. Moreover it will be appreciated that the apparatus can be used both with missiles configured for drop launch and for missiles configured for eject launch.

It will also be appreciated that other modifications to the apparatus will be possible. For example, whilst in the above it has been described to use a mechanical switch located on the missile to confirm jettison of the apparatus from the missile, in alternative embodiments it may be that the apparatus includes a transmitter operable to send a continuous signal to the missile. The continuous signal may for example be a series of pulses. The missile may then determine successful jettison as a consequence of cessation of the continuous signal. Further alternatively, an interface disconnected condition could be detected by the missile when the electrical interface interlock is removed to the apparatus due to its jettison.

The invention claimed is:

1. Apparatus for providing an interface between a missile and a launch platform, the apparatus comprising one or more rocket motors, and a jettison device operable to jettison the apparatus from the missile; the apparatus being configured to launch from the launch platform with the missile and to jettison from the missile after operation of the rocket motors.

2. The apparatus as claimed in claim 1, further comprising one or more sensors, said one or more sensors including one or more of: an altimeter, an inertial measurement unit, a satellite navigation system, a timer, and a tilt sensor.

3. The apparatus as claimed in claim 2, further comprising a processor operable to initiate jettison of the apparatus from the missile; wherein the processor is in operative communication with the one or more sensors so as to determine when to jettison the apparatus from the missile.

4. The apparatus as claimed in claim 3, wherein said determination is made in dependence on one or more predetermined conditions, said one or more predetermined conditions including one or more of: missile speed; missile altitude; time elapsed since launch from the launch platform; and position of the missile.

5. The apparatus as claimed in claim 1, the apparatus further comprising:

a first mechanical interface attachable to the launch platform;

a second mechanical interface attachable to the missile; and an electronic interface arranged to provide electrical communication between the missile and the launch platform.

6. The apparatus as claimed in claim 5, wherein the launch platform comprises a rail launcher, and the first mechanical interface is configured to be attachable to the rail launcher.

7. The apparatus as claimed in claim 5, wherein the missile comprises lug mounts adapted for a drop launch, and the second mechanical interface is configured to be attachable to the lug mounts.

8. A method of adapting a drop-launch missile such that the drop-launch missile can be launched in combination with the apparatus of claim 1, the method comprising the steps of:

i. identifying external components on the missile that are incompatible with the apparatus; and ii. moving said external components to a location that is compatible with the apparatus, or removing said external components.

9. The method of claim 8, further comprising the step of adapting missile control surfaces such that they are suitable for controlling the missile during and immediately after operation of the one or more rocket motors.

10. A weapon system comprising a launch platform, a missile, and an apparatus for providing an interface between the launch platform and the missile, the apparatus comprising:

a first mechanical interface attachable to the launch platform;

a second mechanical interface attachable to the missile;

an electronic interface arranged to provide electrical communication between the missile and the launch platform;

one or more rocket motors; and a jettison device operable to jettison the apparatus from the missile;

wherein the apparatus is configured to launch from the launch platform with the missile, and to jettison from the missile after operation of the rocket motors.

11. The weapon system as claimed in claim 10, wherein the launch platform is an aircraft.

12. The weapon system as claimed in claim 11, wherein the launch platform is a helicopter.

13. The weapon system as claimed in claim 10, wherein the launch platform comprises a rail launcher, and the first mechanical interface is configured to be attachable to the rail launcher, and wherein the missile comprises lug mounts adapted for a drop launch, and the second mechanical interface is configured to be attachable to the lug mounts.

14. Apparatus for providing an interface between a missile and a launch platform, the apparatus comprising one or more rocket motors, a tilt sensor configured to determine an orientation of the apparatus and a jettison device operable to jettison the apparatus from the missile when the apparatus is at a predetermined orientation; the apparatus being configured to launch from the launch platform with the missile and to jettison from the missile after operation of the rocket motors and when the apparatus is at the predetermined orientation.

15. The apparatus of claim 14, wherein before the apparatus is jettisoned from the missile, the rocket motors are burned out and after the apparatus is jettisoned, the apparatus falls to the ground via gravity.

16. The apparatus of claim 15, wherein the apparatus further comprises an electronic interface arranged to provide electrical communication between the missile and the launch platform, wherein the apparatus is configured to provide targeting details from the launch platform to the missile via the electronic interface, and wherein, after the rocket motors are burned out and before the apparatus is jettisoned, the apparatus is propelled based on the targeting details.

17. The apparatus of claim 16, wherein the apparatus is configured to convert information provided from the launch platform in a first databus standard into a second databus standard for used by the missile.

18. The apparatus of claim 14, wherein after the apparatus is launched from the launch platform, the apparatus is configured to rotate from a launch orientation to the predetermined orientation.

* * * * *